United States Patent [19]

Tremmel

[11] 4,450,051

[45] May 22, 1984

[54] BRIGHT NICKEL-IRON ALLOY ELECTROPLATING BATH AND PROCESS

[75] Inventor: Robert A. Tremmel, Woodhaven, Mich.

[73] Assignee: OMI International Corporation, Warren, Mich.

[21] Appl. No.: 410,685

[22] Filed: Aug. 23, 1982

Related U.S. Application Data

[63] Continuation-in-part of Ser. No. 224,773, Jan. 13, 1981, abandoned, and Ser. No. 224,774, Jan. 13, 1981, abandoned.

[51] Int. Cl.[3] ..... C25D 3/56

[52] U.S. Cl. ..... 204/43 T

[58] Field of Search ..... 204/43 T

[56] References Cited

U.S. PATENT DOCUMENTS

| | | | |
|---|---|---|---|
| 2,800,440 | 7/1957 | Brown | 204/49 |
| 3,031,386 | 4/1962 | Tsu et al. | 204/43 T |
| 3,804,726 | 4/1974 | Passal | 204/43 T |
| 3,806,429 | 4/1974 | Clauss et al. | 204/41 |
| 3,878,067 | 4/1975 | Tremmel | 204/43 T |
| 3,922,209 | 11/1975 | Passal | 204/43 T |
| 3,974,044 | 8/1976 | Tremmel | 204/43 T |

*Primary Examiner*—G. L. Kaplan

*Attorney, Agent, or Firm*—Richard P. Mueller

[57] ABSTRACT

An aqueous bath and process suitable for the electrodeposition of bright, high-leveling nickel-iron alloy deposits on a conductive substrate comprising controlled, effective amounts of nickel ions, iron ions, an iron solubilizing agent, a buffering agent, a primary brightening agent, hydrogen ions to provide a pH of about 2.6 to 4.5 and at least one bath soluble additive agent present in an amount of at least about 2 mg/l, selected from propargyl sulfonic acid, 1-butyne-3-sulfonic acid, 1-pentyne-5-sulfonic acid, 2-butyne-1-sulfonic acid and the alkali metal and ammonium salts thereof. A particularly preferred additive agent comprises propargyl sulfonic acid and the alkali metal and ammonium salts thereof. The invention further contemplates the use of the aforementioned additive agent as a replenishing agent for nickel-iron electroplating solutions and as a rejuvenating agent for restoring the activity and capacity of such aqueous baths to deposit bright, high-leveling nickel-iron alloy deposits.

21 Claims, No Drawings

BRIGHT NICKEL-IRON ALLOY ELECTROPLATING BATH AND PROCESS

This is a continuation-in-part of Ser. No. 224,773 and Ser. No. 224,774, both filed Jan. 13, 1981 and now both abandoned.

BACKGROUND OF THE INVENTION

A variety of aqueous electroplating baths and processes are known in the art and are in widespread commercial use for electrodepositing a nickel-iron alloy on electrically conductive substrates. Such nickel-iron alloy deposits possess excellent corrosion resistance and are particularly useful for providing decorative finishes on corrosion susceptible substrates over which a subsequent electrodeposit of chromium is applied. It is extremely important that such nickel-iron decorative deposits are characterized by their high-leveling properties, exceptional brightness and good ductility and that these beneficial characteristics are uniform over the entire electrodeposit.

Typical of known nickel-iron electroplating bath compositions and processes are those described in U.S. Pat. Nos. 3,354,059; 3,795,591; 3,806,429; 3,812,566; 3,878,067; 3,974,044; 3,994,694; 4,002,543; 4,089,754; 4,101,387; 4,134,802 and 4,179,343. While certain of the nickel-iron plating bath compositions and processes as described in the aforementioned United States Patents have provided satisfactory electrodeposits for use in decorative applications, a continuing problem associated with such and other nickel-iron plating baths is their susceptibility or sensitivity to contaminants and organic degradation products formed during prolonged use of such baths detracting from the character and properties of the electrodeposit. This problem is particularly pronounced in electroplating baths designed to electrodeposit alloys containing high percentages of iron, such as for example, alloys containing above about 35% iron and operating at a pH above about 3.4. The progressive contamination of such electroplating baths with greases, oils and organic degradation products of the organic bath additives employed, have been found to cause a progressive deterioration of the quality of the electrodeposit and to greatly restrict the permissible bath operating parameters requiring relatively stringent control to maintain high quality electrodeposits. The progressive deterioration of the bath is typically evidenced by electrodeposits which contain white, blotchy or black areas that form in the intermediate and low current density areas of the conductive substrate being plated. Additionally, adverse physical properties of the electrodeposit is also evidenced, including high stress, poor ductility and inadequate adhesion in some instances.

In accordance with the present invention, an improved bath composition and process is provided which overcomes the detrimental effects of bath contamination during operation, which permits operation at a higher pH level to achieve excellent brightness and leveling, which permits more latitude in the parameters of bath control, and which facilitates the attainment of the desired high quality nickel-iron alloy deposit on a consistent basis. The invention further contemplates the use of a particular replenishing agent for conventional nickel-iron baths which when employed in controlled amounts is effective to achieve the aforementioned benefits. Additionally, the invention also contemplates a process for rejuvenating conventional nickel-iron electroplating baths which have been rendered inefficient or ineffective to achieve the desired high quality deposits due to the accumulation of contaminants therein by the controlled addition of a rejuvenating agent effective to restore the electroplating bath to its original operating efficiency.

SUMMARY OF THE INVENTION

The benefits and advantages of the present invention in accordance with the composition aspects thereof are achieved by an aqueous acidic bath of the type suitable for electrodepositing a bright, high-leveling nickel-iron alloy deposit on a conductive substrate containing nickel ions, iron ions, an iron solubilizing agent present in an amount to maintain the desired concentration of iron ions in solution, a buffering agent, a primary brightening agent, preferably in combination with one or more secondary brightening agents of the types known in the art present in an amount sufficient to produce a bright, leveled nickel-iron deposit, hydrogen ions to provide a pH within a range of about 2.6 to about 4.5 and at least one bath soluble addition agent, present in an amount of at least about 2 milligrams per liter (mg/l) selected from propargyl sulfonic acid, 1-butyne -3- sulfonic acid, 1-pentyne -5- sulfonic acid, 2-butyne -1- sulfonic acid and the alkali metal and ammonium salts thereof.

A particularly preferred additive agent corresponding to the foregoing structural formula is propargyl sulfonic acid and the alkali metal and ammonium salts thereof as well as mixtures thereof. The additive agent is generally employed in amounts up to about 300 mg/l with amounts of about 5 to 80 mg/l being preferred.

In accordance with the process aspects of the present invention, a bright, decorative, high-leveling nickel-iron electrodeposit is produced on a conductive substrate by immersing the substrate while cathodically charged in an electroplating bath of the aforementioned type controlled at a temperature of from about 105 to 180° F. for a period of time to effect the electrodeposition of the nickel-iron alloy until a desired thickness is obtained. The electrodeposition of the nickel-iron alloy can be achieved over a broad current density range such as from about 5 to about 100 amperes per square foot (ASF). The present invention further contemplates the process of replenishing a nickel-iron bath by periodic and/or continuous addition of the additive agent to maintain the bath at optimum operating efficiency as well as the process of rejuvenating a contaminated, inefficient bath by the addition of the rejuvenating agent to restore the bath to its optimum operating condition.

Additional advantages and benefits of the present invention will become apparent upon a reading of the description of the preferred embodiments taken in conjunction with the specific examples provided.

DESCRIPTION OF THE PREFERRED EMBODIMENTS

The present invention is particularly applicable for the electrodeposition of decorative nickel-iron alloy deposits on electrically conductive substrates which can be utilized as a base for the subsequent electrodeposition of chromium in order to achieve the desired decorative and/or corrosion resistant properties. While the present invention is primarily applicable for the electrodeposition of nickel-iron alloys on metallic substrates, it is also contemplated that the invention can be applied to plastic substrates which have been subjected to a suitable pretreatment in accordance with well-known techniques to achieve an electrically conductive coating thereover such as a nickel or copper layer rendering the plastic substrate receptive to the nickel-iron alloy electroplating operation. Typical of such plastic materials which can be electroplated are ABS, polyolefin, polyvinyl chloride, and phenol-formaldehyde polymers.

In accordance with the composition aspects, the aqueous electroplating bath contains as essential constituents, nickel ions, iron ions, and iron solubilizing agent present in an amount to maintain the desired concentration of iron ions in solution, a buffering agent, a primary carrier brightener, preferably in combination with one or more secondary brightening agents to produce a bright, high-leveling nickel-iron alloy deposit, hydrogen ions to provide a pH of from about 2.6 to about 1.5, and preferably 3.2 to about 3.8, and at least one bath soluble acetylenic additive agent, present in an amount of at least about 2 mg/l, selected from propargyl sulfonic acid, 1-butyne -3- sulfonic acid, 1- pentyne -5- sulfonic acid, 2- butyne -1- sulfonic acid and the alkali metal and ammonium salts thereof.

Of these, propargyl sulfonic acid and its bath compatible salts comprise the preferred additive agent. The additive agent or mixtures thereof is usually employed in amounts of about 2 to about 300 mg/l with amounts of about 5 to about 80 mg/l being preferred.

The addition of the organic additive agent of the present invention enables the electrodeposition of nickel-iron alloys of relatively high iron content, e.g., about 35% and higher employing a bath operating pH in the upper range at which improved brightness and leveling of the deposit is attained. The additive agent further reduces the sensitivity of the bath to organic contaminants such as oils, greases, and organic degradation products of the organic additives present in the bath enabling continued operation without imposing stringent control of the bath operating parameters to avoid blotchy or non-uniform deposits. The present invention further contemplates the replenishment and rejuvenation of contaminated baths which have lost their effectiveness and capacity to produce high quality nickel-iron alloy deposits by the addition of controlled effective amounts of the additive agent whereby proper bath operation is restored.

In accordance with the composition aspects of the present invention, the nickel and iron ions are introduced into the bath employing bath soluble and compatible nickel and iron compounds. Preferably, inorganic nickel salts are employed such as nickel sulfate, nickel chloride, and the like as well as other nickel materials such as nickel sulfamate and the like. When nickel sulfate or sulfamate salts are used they are conventionally employed in amounts ranging from 40 up to about 300 g/l (calculated as nickel sulfate hexahydrate). Nickel chloride can also be used and is normally employed in an amount ranging from about 40 to about 250 g/l. The chloride or halide ions introduced provide for satisfactory conductivity of the bath and also provide satisfactory corrosion properties of the soluble anodes.

The iron compounds preferably comprise inorganic ferrous salts such as ferrous sulfate, ferrous chloride, and the like. Such ferrous salts are usually employed in amounts ranging from about 2 up to about 60 g/l. Additionally, other bath soluble compatible iron salts can be employed such as soluble ferrous fluoborate, sulfamate, and the like.

The concentration of nickel and iron ions in the bath is usually controlled to provide a weight ratio of nickel to iron ranging from about 5:1 up to about 50:1. The concentration of nickel ions in the bath is at least about 10 g/l while the concentration of the iron ions is at least about 0.2 g/l with the specific amount present being controlled to provide the appropriate weight ratio as hereinabove set forth.

In order to maintain the ferrous and ferric ions in solution an iron solubilizing agent is employed in an amount to maintain the desired concentration thereof in the bath in a form available for electrodeposition on the substrate. The solubilizing agent maintains the iron ions in solution by a complexing function and/ or a reducing function of ferric to ferrous ions to avoid precipitation of ferric hydroxide. The iron solubilizing agent employed may comprise any of those heretofore used in the art and typically comprise hydroxy substituted lower aliphatic carboxylic acids having from 2 to 11 carbon atoms, from 1 to 6 hydroxyl groups and from 1 to 3 carboxyl groups such as ascorbic acid, isoascorbic acid, citric acid, malic acid, glutaric acid, gluconic acid, muconic acid, glucoheptonic acid, glycollic acid, tartaric acid and the like as well as the water soluble and bath compatible salts thereof such as ammonium, alkali metal, as well as nickel and iron salts thereof.

The iron solubilizing agent is usually employed in amounts of about 5 up to about 100 g/l with amounts of about 10 to about 30 g/l being preferred. Usually, concentrations of the iron solubilizing agent above about 50 g/l are unnecessary and in some instances are undesirable due to the formation of organic degradation products over prolonged operating periods of the bath. Such higher concentrations are also undesirable from an economic standpoint.

The ratio of the iron solubilizing agent relative to the iron concentration in the bath is preferably within the range from about 1:1 up to about 20:1. At ratios below 1:1, the iron constituent may precipitate out while at ratios above about 20:1 excessive concentrations of the solubilizing agent may be present resulting in the disadvantages and potential problems hereinabove set forth.

A further essential constituent of the bath is a buffering agent such as boric acid, acetic acid and the like as well as the alkali metal, ammonium nickel and iron salts thereof and other bath soluble and compatible salts as well as mixtures thereof. The buffering agent is usually employed in an amount of about 20 up to about 60 g/l with concentrations of about 40 to about 50 g/l being preferred. Particularly satisfactory results are obtained employing boric acid and the bath soluble salts thereof.

The bath further contains as an essential constituent, a controlled amount of a primary or so-called carrier brightener preferably in further combination with secondary brighteners to attain the exceptional brightness and high-leveling of the nickel-iron deposit. The primary brighteners are usually employed in amounts ranging from about 0.5 to about 20 g/l with amounts of about 2 to about 8 g/l being preferred. The secondary brighteners, when used, are usually employed in amounts of about 0.25 mg/l up to about 1 g/l with amounts of about 10 to about 100 mg/l being preferred. The primary and secondary brighteners, when an acid is involved, can be introduced into the bath in the form of the acid itself or as a salt having bath soluble cations such as the alkali metal ions including ammonium.

The primary brighteners suitable for use include those as described in U.S. Pat. No. 3,974,044, the substance of which is incorporated herein by reference. Such primary brighteners as described in the aforementioned patent comprise sulfo-oxygen compounds of sulfur-bearing compounds as further described in "Modern Electroplating" published by John Wiley and Sons, second edition, page 272. Included among such primary brighteners are saccharin, sulfobenzaldehyde, benzenesulfonamide, sodium allyl sulfonate, and the like as well as mixtures thereof. Other bath soluble sulfo-oxygen compounds are those such as the unsaturated aliphatic sulfonic acids, mononuclear and binuclear aromatic sulfinic acids, mononuclear aromatic sulfonamides and sulfonimides, and the like. Of the foregoing, saccharin itself or saccharin in combination with allyl sulfonate and/or vinyl sulfonate comprises a preferred primary brightener.

Suitable secondary brighteners include acetylenic nickel brighteners such as the acetylenic sulfo-oxygen compounds and acetylenic nickel brighteners as described in U.S. Pat. No. 3,366,667 such as the polyethers resulting from the condensation reaction of acetylenic alcohols and diols such as, propargyl alcohol, butyndiol, and the like and lower alkylene oxides such as, epichlorohydrin, ethylene oxide, propylene oxide and the like.

Additional secondary brighteners that are suitable include nitrogen heterocyclic quaternary or betaine nickel brighteners which are usually employed in amounts of about 1 to about 150 mg/l. Compounds of this type suitable are those described in U.S. Pat. No. 2,647,866 and the nitrogen heterocyclic sulfonates described in U.S. Pat. No. 3,023,151. Preferred compounds described therein are the pyridine quaternaries or betaines or the pyridine sulfobetaines. Suitable quaternaries that may be employed are quinaldine propane sultone, quinaldine dimethyl sulfate, quinaldine allyl bromide, pyridine allyl bromide, isoquinaldine propane sultone, isoquinaldine dimethyl sulfate, isoquinaldine allyl bromide, and the like.

In addition, secondary brighteners further include the reaction product of a polyamine-type brightener which has a molecular weight ranging from 300 to about 24,000, and an alkylating agent of the type described in U.S. Pat. No. 4,002,543 the substance of which is incorporated herein by reference. Exemplary alkylating agents are dimethyl sulfate, chloroacetic acid, allyl bromide, propane sultone, benzyl chloride or propargyl bromide. The polyamine brightener may be sulfonated utilizing as exemplary compounds sulfamic acid, chloro sulfonic acid and the like. The ratio of polyamine to alkylating agent or to the sulfonating agent can be varied so that every amino group need not be alkylated or sulfonated as the case may be.

In addition to the essential primary and optional secondary brighteners and other bath constituents, a further optional addition agent comprises special carrier agents of the type described in U.S. Pat. No. 3,806,429, the substance of which is incorporated herein by reference. Such optional special additives are not required in achieving the exceptional brightness and high leveling in accordance with the present invention but their inclusion in the bath is usually preferred to assure bright nickel-iron deposits over the entire surface of the substrate, even those exposed to very low current densities. Such specialty additives comprise organic sulfide compounds which are normally employed in amounts ranging from about 0.5 to about 40 mg/l and are of the formula:

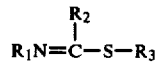

where $R_1$ is hydrogen or a carbon atom of an organic radical, $R_2$ is hydrogen or a carbon atom of an organic radical and $R_3$ is a carbon atom of an organic radical. $R_1$ and $R_2$ or $R_3$ may be linked together through a single organic radical.

Typically, the bath soluble organic sulfide compounds can be 2-amino thiazoles and isothioureas. 2-aminothiazole and- 2-aminobenzothiazole can be reacted with bromomethane sulfonate, propane sultone, benzyl chloride, dimethylsulfate, diethyl sulfate, methyl bromide, propargyl bromide, ethylene dibromide, allyl bromide, methyl chloro acetate, sulfophenoxyethylene bromide, to form compounds suitable for use. Substituted 2-aminothiazoles and 2-aminobenzothiazoles, such as 2-amino-5-chlorothiazole, 2-amino-4-methylthiazole, etc. can also be employed. Thiourea can be reacted with propiolactone, butyrolactone, chloroacetic acid, chloropropionic acid, propane sultone, dimethyl sulfate, etc. Also, phenyl thiourea, methyl thiourea, allyl thiourea and other similar substituted thioureas can be used to form suitable reacted compounds.

The bath further contains as an essential constituent, hydrogen ions to provide a pH of about 2.6 to about 4.5 and preferably from about 3.2 to 3.8. The hydrogen ions can suitably be introduced employing any of the acids conventionally used in nickel-iron plating baths of which sulfuric acid and hydrochloric acid are preferred.

The bath may further contain as an optional constituent, a controlled amount of a reducing saccharide. The reducing saccharide or mixture of saccharides which can satisfactorily be employed in accordance with the present invention can be either a monosaccharide or a disaccharide. The monosaccharides can be defined as polyhydroxyaldehydes or polyhydroxyketones with at least three aliphatically bound carbon atoms. The simplest monosaccharides are glyceraldehyde (generally termed aldose) and dihydroxyacetone (generally termed ketose). Other suitable monosaccharides useful in the practice of the present invention include dextrose, sorbose, fructose, xylose, erythrose and arabinose. Disaccharides are glucoside-type derivatives of monosaccharides, in which one sugar forms a glucoside with an -OH group of some other sugar. Disaccharides suitable for use in the practice of the present invention include lactose, maltose and turanose, Other disaccharides in which the second monosaccharide may, at least momentarily, possess a free carbonyl group may also be utilized.

The reducing saccharide if used, can be employed in amounts ranging from about 1 to about 50 g/l with amounts of about 2 to about 5 g/l being preferred. The reducing saccharide functions as a mild reducing agent for ferric ions present but additionally provides for exceptional brightness and leveling of the nickel-iron electrodeposit in combination with the tartrate-type complexing agents and primary and secondary brighteners providing a synergistic effect which is not completely understood at the present time.

Further stabilization of the iron ions in the ferrous state is achieved by the addition of ascorbic and/or isoascorbic acid as well as the bath soluble and compatible salts thereof such as the alkali metal salts. When ascorbic and/or isoascorbic acid is employed as the sole iron solubilizing agent, it can be employed in amounts up to about 100 g/l. Preferably, this stabilizing agent is employed in combination with other iron solubilizing agents as hereinabove set forth at concentrations ranging from about 0.5 to about 3 g/l with amounts of about 1 to 2 g/l being preferred.

The use of the reducing saccharide and/or stabilizing agent inhibits the formation of ferric ions in the bath resulting from the oxidation of the ferrous salts originally employed for bath make-up to the ferric state during bath operation. The rate of ferric iron ion formation is a function of the anode area at which oxidation occurs as well as by oxidation particularly when air agitation of the bath is used. It is usually preferred to control the ferric ion concentration in the bath below about 40% of the total iron present.

In accordance with the process aspects of the present invention, substrates to be electroplated are immersed in the electroplating bath while cathodically charged and are electroplated at average current densities of about 5 up to about 100 ASF, preferably 30 to about 60 ASF, for periods of time to provide the desired plating thickness. Usually plating thicknesses for decorative purposes range from about 0.1 mils to about 2 mils with thicknesses of about 0.2 to about 0.5 mils being typical. The operating bath is usually maintained at a temperature ranging from 105° F. up to about 180° F. with temperatures of about 130° F. to about 140° F. being preferred. Plating durations of from about 5 minutes to about 30 minutes are usually satisfactory in consideration of the specific current density employed and the thickness of the plating deposits desired. Agitation of the bath during electroplating is not necessary but is preferred employing conventional agitation means such as mechanical agitation, air agitation, and the like.

In order to further illustrate the electroplating bath and process of the present invention, the following specific examples are provided. It will be understood that the examples are provided for illustrative purposes and are not intended to be limiting of the scope of the present invention as herein described and as set forth in the subjoined claims.

EXAMPLE 1

A nickel-iron electroplating bath is prepared having the following composition:

| Ingredient | Concentration |
|---|---|
| $NiSO_4.6H_2O$ | 150 g/l |
| $NiCl_2.6H_2O$ | 75 g/l |
| $H_3BO_3$ | 50 g/l |
| $FeSO_4.7H_2O$ | 40 g/l |
| Sodium gluconate | 20 g/l |
| Primary brighteners | 7 g/l |
| Secondary brightener | 20 mg/l |

The sodium gluconate comprises the iron solubilizing agent. The primary brighteners comprise a mixture of sulfo-oxygen carrier brighteners comprising 2.5 g/l saccharin and 4.5 g/l sodium allyl sulfonate. The secondary brightener comprises propynoxy ethylene oxide, a reaction product of polyethylene imine (molecular weight 1200) with sulfamic acid and 2-amino thiazole. The bath temperature is controlled at 140° F. and the pH of the bath is adjusted to 3.5. A clean rolled steel panel is plated at 30 ASF for 10 minutes and the resulting deposit was bright but had a dark recess area and an overall white blotchiness in the intermediate current density areas. The concentration of the constituents of the bath are purposely selected to insure that an unacceptable deposit is obtained with a high iron alloy content of about 42.5% iron.

EXAMPLE 2

The nickel-iron electroplating bath of Example 1 is replenished to provide the same bath composition and in addition, 5 mg/l of propargyl sulfonate is added. A clean rolled steel panel is plated under the same conditions as described in Example 1 and the resulting deposit is overall bright with excellent recess areas and the white blotchiness is eliminated.

EXAMPLE 3

A nickel-iron plating solution which has been in commercial operation for about one year was analyzed and found to have the following composition of constituents:

| | |
|---|---|
| $Ni^{+2}$ | 73.75 g/l |
| $NiSO_4.6H_2O$ | 187.50 g/l |
| $NiCl_2.6H_2O$ | 138.85 g/l |
| $H_3BO_3$ | 44.24 g/l |
| Stabilizer* | 17.40 g/l |
| $Fe^{+2}$ | 2.67 g/l |
| $Fe^{+3}$ | 1.61 g/l |
| Primary Brightener | 3.8% |
| Secondary Brightener | 2.3% |
| pH | 3.1 |

*Calculated as tartaric acid and comprises a mixture originally added to the bath containing 65% tartaric acid, 15% lactose and 20% by weight isoascorbic acid.

A clean 3"×5" polished brass panel was plated in the above described plating solution using a standard hull cell apparatus at 2 AMPSfor 10 minutes at 140 ° F. The resulting deposit was overall bright and cloud free across the entire panel.

EXAMPLE 4

The pH of a fresh sample of the nickel-iron plating solution described in Example 3 was increased to 3.5, the iron content increased to 5.0 g/l and the Hull cell panel test was repeated. The resulting deposit was bright in the high current density area hite smokey cloud in the intermediate current density areas and dark and blotchy gray in the low current density areas.

EXAMPLE 5

The pH of a fresh sample of the nickel-iron plating solution of Example 3 was again increased to 3.5, the iron content increased to 5.0 g/l and 5 mg/l of propargyl sulfonate was added to the bath. The Hull cell panel tests were repeated and the resulting deposit was overall bright and cloud free across the entire panel.

EXAMPLE 6

The pH of the solution described in Example 5 was further increased to 3.8, the brighteners and iron replenished and the Hull cell panel tests were repeated. The resulting deposit plated at 2 AMPS for 10 minutes was similar to the panel described in Example 4 but the cloudiness and darkness were not as severe, especially in the intermediate current density areas.

EXAMPLE 7

An additional 5 mg/l of propargyl sulfonate was added to the nickel-iron solution described in Example 6, the brighteners and iron replenished and the Hull cell panel tests were repeated as described in previous Examples. The resulting deposit was now bright and cloud free over the entire panel.

EXAMPLE 8

The commercial nickel-iron plating bath described in Example 3 was placed in a standard Hull cell equipped with air agitation. The pH of the bath was increased to 3.8 and the total iron content was increased to 5.0 g/l. A Hull cell panel was plated at 2 AMPS for ten minutes at 145° F. The resulting deposit was bright in the high current density areas with severe smokiness and grayness in the intermediate current density areas with dark low current density areas.

EXAMPLE 9

15 mg/l of 1-butyne-3-sulfonic acid, sodium salt, was added to the bath described in Example 8, the brighteners and iron replenished and the Hull cell panel test was repeated. Results revealed a slight improvement in deposit quality in that there was some reduction in the intermediate current density cloudiness.

EXAMPLE 10

The concentration of the 1-butyne-3-sulfonic acid, sodium salt, described in Example 9 was increased to 60 mg/l, the brighteners and iron replenished and the Hull cell panel test was repeated. The resulting deposit was overall bright and leveled over the entire panel with only a very slight cloudiness along the meniscus of the plated deposit.

EXAMPLE 11

The commercial plating bath specifically described in Examples 3 and 8 was again used to check the effectiveness of 1-pentyne-5-sulfonic acid. The initial panel without adding the test material was exactly as described in Example 8. 50 mg/l of 1-pentyne-5-sulfonic acid, sodium salt was added to the bath, the brighteners and iron replenished, and the Hull cell panel test repeated. The resulting deposit was overall bright and leveled over the entire panel as well as the meniscus.

EXAMPLE 12

The commercial plating bath specifically described in Examples 3 and 8 was again used to check the effectiveness of 2-butyne-1-sulfonic acid. The initial panel, without adding the test material was exactly as described in Example 8. In subsequent runs, 5, 10 and 20 mg/l of 2-butyne-1-sulfonic acid, sodium salt, were added to the bath, the brightness and iron replenished and the Hull Cell panel tests repeated. In each instance, the resulting deposit was overall bright and leveled over the entire panel, as well as the meniscus.

EXAMPLE 13

The commercial plating bath specifically described in Examples 3 and 8 was again used to check the effectiveness of acetylenic compounds having structures similar to the usable compounds encompassed by the group hereinabove set forth.

The initial panel before adding the test material was exactly as described in Example 8. The compounds to be tested were added to the bath, the brighteners and the iron replenished, and the Hull cell panel tests repeated. In each instance, the resulting deposit showed no improvement and, in some instances, the intermediate current density cloudiness worsened and the recess areas appeared even darker. Using this procedure, the compounds tested and the amounts in which they were added were as follows:

| Acetylenic Compound | Amount (mg/l) |
|---|---|
| 3-heptyne-7-sulfonic acid sodium salt | 50 and 100 |
| 1-hydroxy-2-butyne-4-sulfonic acid, sodium salt | 5, 10 and 20 |
| 1-pentyne-3-sulfonic acid, sodium salt | 5, 10 and 20 |
| phenylpropyne sulfonic acid, sodium salt | 5, 10 and 20 |

While it will be apparent that the preferred embodiments of the invention disclosed are well calculated to fulfill the obJects above stated, it will be appreciated that the invention is susceptible to modification, variation and change without departing from the proper scope or fair meaning of the subjoined claims.

I claim:

1. An aqueous bath suitable for the electrodeposition of bright, high-leveling nickel-iron alloy deposits comprising nickel ions, iron ions, an iron solubilizing agent present in an amount to maintain the desired concentration of iron ions in solution, a buffering agent, a primary brightening agent present in an amount sufficient to produce a bright nickel-iron deposit, hydrogen ions to provide a pH of about 2.6 to about 4.5 and at least one bath soluble additive agent present in an amount of at least about 2 mg/l, selected from propargyl sulfonic acid, 1-butyne-3-sulfonic acid, 1-pentyne-5-sulfonic acid, 2-butyne-1-sulfonic acid and the alkali metal and ammonium salts thereof.

2. The bath as defined in claim 1 in which said additive agent is present in an amount of about 2 up to about 300 mg/l.

3. The bath as defined in claim 1 in which said additive agent is present in an amount of about 5 up to about 80 mg/l.

4. The bath as defined in claim 1 in which said nickel ions are present in an amount of at least about 10 g/l and said iron ions are present in an amount of at least about 0.2 g/l and the weight ratio of nickel ions to iron ions ranges from about 5:1 to about 50:1.

5. The bath as defined in claim 1 in which said hydrogen ions are present to provide a pH of about 3.2 to about 3.8.

6. The bath as defined in claim 1 in which said buffering agent is selected from the group consisting of boric acid, acetic acid, and the bath compatible and soluble salts thereof as well as mixtures thereof.

7. The bath as defined in claim 1 in which said iron solubilizing agent is present in an amount of about 5 to about 100 g/l.

8. The bath as defined in claim 1 in which said iron solubilizing agent is present in an amount of about 10 to about 30 g/l.

9. The bath as defined in claim 1 further including at least one secondary brightening agent present in an amount of about 0.25 mg/l up to about 1 g/l.

10. The bath as defined in claim 1 further including at least one secondary brightening agent present in an amount of about 10 to about 100 mg/l.

11. The bath as defined in claim 1 in which said iron solubilizing agent comprises a hydroxy substituted lower aliphatic carboxylic acid having from 2 to 11 carbon atoms, from 1 to 6 hydroxyl groups, from 1 to 3 carboxyl groups and the bath soluble and compatible salt thereof and mixtures thereof.

12. The bath as defined in claim 1 in which said iron solubilizing agent comprises an acid selected from the group consisting of ascorbic and isoascorbic acid and the bath soluble and compatible salts thereof.

13. The bath as defined in claim 1 in which said iron solubilizing agent includes a reducing saccharide.

14. The bath as defined in claim 1 in which said iron solubilizing agent comprises at least one acid selected from the group consisting of tartaric, ascorbic, isoascorbic, gluconic, citric, glucoheptonic, malic, glutaric, muconic, glycollic as well as the bath soluble and compatible salts thereof and mixtures thereof.

15. A process for electroplating a bright, high-leveling nickel-iron alloy deposit on an electrically conductive substrate comprising the steps of immersing the substrate in an aqueous bath as defined in claim 1, 2, 3, 4, 5, 6, 7, 8, 9, 10, 11, 12, 13 or 14, applylng a cathodic charge to said substrate to effect a progressive deposition of a nickel-iron electrodeposit thereon, controlling the bath at a temperature of about 105° to about 180° F., and continuing the electrodeposition of said nickel-iron electrodeposit until a desired thickness is obtained.

16. In an aqueous bath suitable for the electrodeposition of bright, high-leveling nickel-iron alloy deposits containing nickel ions, iron ions, an iron solubilizing agent present in an amount to maintain the desired concentration of iron ions in solution, a buffering agent, a primary brightening agent present in an amount sufficient to produce a bright nickel-iron deposit, and hydrogen ions to provide a pH of about 2.6 to about 4.5, the improvement comprising a replenishing agent for addition to said bath to provide a concentration of at least about 2 mg/l, said replenishing agent comprising at least one compound selected from propargyl sulfonic acid, 1-butyne-3-sulfonic acid, 1-pentyne-5-sulfonic acid, 2-butyne-1-sulfonic acid and the alkali metal and ammonium salts thereof.

17. The bath as defined in claim 16 in which said replenishing agent is present in an amount of about 2 to about 300 mg/l.

18. The bath as defined in claim 16 in which said replenishing agent is present in an amount of about 5 to about 80 mg/l.

19. A process for rejuvenating an aqueous bath to restore its capacity to electrodeposit bright, high-leveling nickel-iron alloy deposits, said bath containing nickel ions, iron ions, an iron solubilizing agent present in an amount to maintain the desired concentration of iron ions in solution, a buffering agent, a primary brightening agent, hydrogen ions to provide a pH of about 2.6 to about 4.5, said process comprising the steps of adding to said bath a rejuvenating agent in an amount sufficient to restore the capacity of said bath to electrodeposit a bright, high-leveling nickel-iron alloy, said rejuvenating agent comprising at least one compound selected from propargyl sulfonic acid, 1-butyne-3-sulfonic acid, 1-pentyne-5-sulfonic acid, 2-butyne-1- sulfonic acid and the alkali metal and ammonium salts thereof.

20. The process as defined in claim 19 in which said rejuvenating agent is added in an amount of about 2 to about 300 mg/l.

21. The process as defined in claim 19 in which said rejuvenating agent is added in amount of about 5 to about 80 mg/l.

* * * * *